US010288242B2

(12) United States Patent
Reisinger et al.

(10) Patent No.: US 10,288,242 B2
(45) Date of Patent: May 14, 2019

(54) LASER LIGHTING DEVICE FOR VEHICLE HEADLAMPS HAVING A PLURALITY OF LASER LIGHT SOURCES, A CORESPONDING PLURALITY OF LIGHT GUIDES EACH HAVING A DIFFERENT SIZED CROSS SECTION, OPTICAL SCANNER AND A LIGHT CONVERSION MEANS

(71) Applicant: ZKW Group GmbH, Wieselburg (AT)

(72) Inventors: Bettina Reisinger, Amstetten (AT); Markus Reinprecht, Pielachhauser (AT); Klaus-Dieter Scharf, Koenigsfeld (DE)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/749,534

(22) PCT Filed: Jul. 19, 2016

(86) PCT No.: PCT/AT2016/060009

§ 371 (c)(1),
(2) Date: Feb. 1, 2018

(87) PCT Pub. No.: WO2017/020054

PCT Pub. Date: Feb. 9, 2017

(65) Prior Publication Data

US 2018/0224080 A1 Aug. 9, 2018

(30) Foreign Application Priority Data

Aug. 3, 2015 (AT) ..... A 50700/2015

(51) Int. Cl.
*F21S 41/24* (2018.01)
*F21S 41/16* (2018.01)
(Continued)

(52) U.S. Cl.
CPC ..... *F21S 41/16* (2018.01); *F21S 41/176* (2018.01); *F21S 41/24* (2018.01); *F21S 41/675* (2018.01); *F21Y 2115/30* (2016.08)

(58) Field of Classification Search
CPC ..... F21S 41/16; F21S 41/24; F21Y 2115/30
See application file for complete search history.

(56) References Cited

U.S. PATENT DOCUMENTS 9,120,421 B2 * 9/2015 Takahashi ..... B60Q 1/0047
9,261,259 B2 2/2016 Shiomi et al.
(Continued)

FOREIGN PATENT DOCUMENTS

DE 102008022795 A1 11/2009
JP 2003172900 A 6/2003
(Continued)

OTHER PUBLICATIONS

Search Report issued in Austrian Application No. A 50700/2015, completed Jun. 29, 2016 (1 page).
(Continued)

*Primary Examiner* — Robert J May
(74) *Attorney, Agent, or Firm* — Eversheds Sutherland (US) LLP

(57) ABSTRACT

The invention relates to a laser lighting device for vehicles comprising two or more laser light sources, wherein each is configured to generate a primary laser light beam, a light guide associated with each laser light source, wherein each primary laser light beam is coupled into the first end of the guide and coupled out of the second end of the guide as a secondary laser light beam, and each secondary laser light beam is directed onto a light conversion means so as to generate a predefined luminous image thereon, which via a projection system associated with the light conversion means is projected as a light image onto the roadway,
(Continued)

wherein each primary laser light beam has a first intensity profile, each secondary laser light beam has a second intensity profile different from the first intensity profile, and each secondary laser light beam is directed via a microscanner onto the light conversion means.

14 Claims, 4 Drawing Sheets

(51) Int. Cl.

| | |
|---|---|
| ***F21S 41/675*** | (2018.01) |
| ***F21S 41/176*** | (2018.01) |
| *F21Y 115/30* | (2016.01) |

(56) References Cited

U.S. PATENT DOCUMENTS

| | | | |
|---|---|---|---|
| 9,423,091 | B2 | 8/2016 | Reinprecht et al. |
| 9,562,661 | B2 | 2/2017 | Kikima et al. |
| 9,599,300 | B2 | 3/2017 | Takahashi et al. |
| 9,677,736 | B2 | 6/2017 | Ravier et al. |
| 9,777,901 | B2 | 10/2017 | Reinprecht et al. |
| 9,903,555 | B2 * | 2/2018 | Ohno ..... B60Q 1/085 |
| 2012/0051074 | A1 | 3/2012 | Takahashi |
| 2012/0106189 | A1 | 5/2012 | Takahashi et al. |
| 2013/0258689 | A1 | 10/2013 | Takahira et al. |
| 2013/0265561 | A1 | 10/2013 | Takahira et al. |
| 2015/0016134 | A1 | 1/2015 | Erdl et al. |
| 2015/0062943 | A1 | 3/2015 | Takahira et al. |

FOREIGN PATENT DOCUMENTS

| | | | |
|---|---|---|---|
| JP | 2013-232390 | A | 11/2013 |
| JP | 2014-010918 | A | 1/2014 |
| WO | 2015111649 | A1 | 7/2015 |

OTHER PUBLICATIONS

International Search Report for PCT/AT2016/060009, dated Nov. 2, 2016 (2 pages).

Communication for European Patent Application No. 16750360.6 dated Jan. 2, 2019.

* cited by examiner

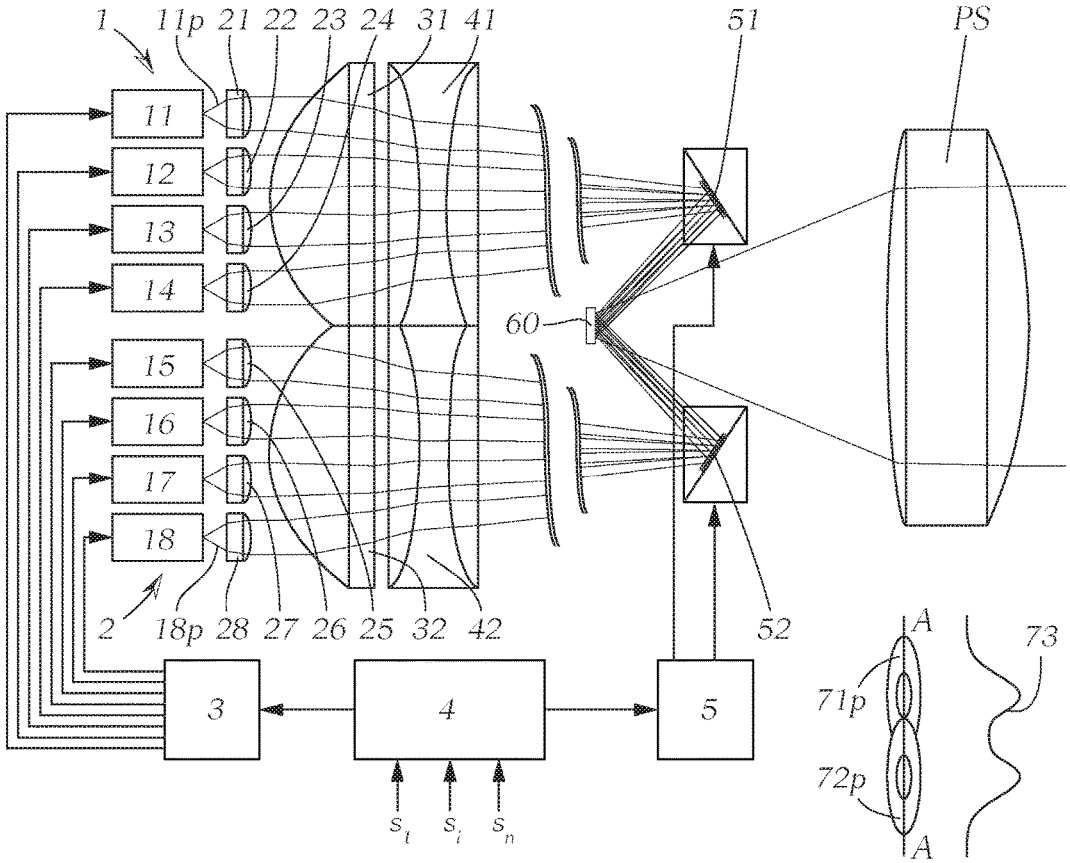
Fig. 1
Fig. 1a
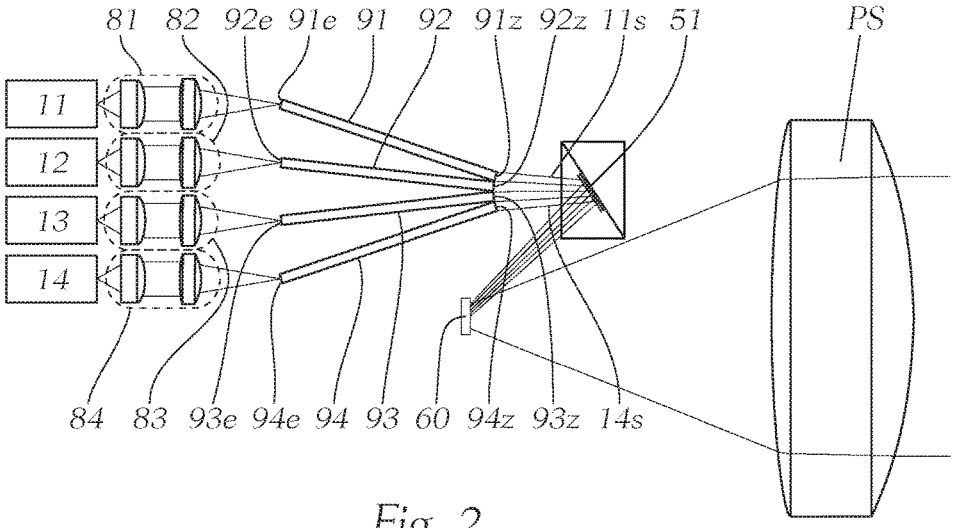
Fig. 2

LASER LIGHTING DEVICE FOR VEHICLE HEADLAMPS HAVING A PLURALITY OF LASER LIGHT SOURCES, A CORESPONDING PLURALITY OF LIGHT GUIDES EACH HAVING A DIFFERENT SIZED CROSS SECTION, OPTICAL SCANNER AND A LIGHT CONVERSION MEANS

The invention relates to a laser lighting device for vehicles comprising two or more laser light sources, wherein each is configured to generate a primary laser light beam, a light guide associated with each laser light source, wherein each primary laser light beam is coupled into a first end of the light guide and decoupled from a second end of the light guide as a secondary laser light beam, and each secondary laser light beam is directed onto a light conversion means so as to generate a predefined luminous image thereon, which via a projection system associated with the light conversion means is projected as a light image onto the roadway.

Moreover, the invention relates to a headlight comprising at least one such laser lighting device.

Furthermore, the invention relates to a vehicle comprising at least one such headlight.

Headlights operating by way of scanning laser beams using a light conversion means are known. They usually generate an luminous image on a light conversion means, often simply referred to as a "phosphor," on which the blue laser light, for example, is essentially converted into "white" light by way of fluorescence. The generated luminous image is then projected onto the roadway with the aid of the imaging system, such as a lens optical system. The microscanner is generally a beam deflection means, such as a micromirror, which can be moved about one axis or about two axes, so that, for example, a row-by-row luminous image is "written." The modulation of the laser light source determines the desired luminance for every pixel or every row of the luminous image, which must satisfy statutory requirements for the projected light image on the one hand, and must be adaptable to the particular driving situation on the other.

The use of the microscanner having one or more laser beams, which are modulated synchronously with the mirror oscillation, makes it possible to generate a virtually arbitrary light distribution. Such a method, in principle, is also known for so-called pico projectors and head-up displays, which likewise use micromirrors that are designed as microelectromechanical systems (MEMS). In contrast to such systems, which are frequently used in entertainment electronics, however, considerably higher laser power is required for headlights. However, it is not necessary to represent a colored light distribution. As mentioned above, usually blue laser light, which stems from laser diodes, for example, is employed. In light of the required high laser power in the order of magnitude of 5 to 30 watt, it is important to utilize the laser power installed in a headlight in the best possible manner.

In particular, what are known as 1D microscanner systems are used in headlights. Multiple blue laser diodes are disposed in such a way that the laser beams they generate are directed onto the phosphor by way of a single 1D microscanner. A "1D microscanner" shall be understood to mean a microscanner movable about a single axis. Each laser diode illuminates a dedicated region on the phosphor, so that separate rows are "written."

If the height of the rows in the far field is to be different (for example, so as to divide a light distribution as efficiently as possible among individual rows), the spot diameter of the laser diodes, which is to say the diameter of a luminous spot generated by the corresponding laser diode due to fluorescence, on the phosphor must be different. Depending on the application, these values may vary drastically, for example when row heights between 0.2 mm and 0.9 mm are to be achieved on a phosphor.

The light intensity in such a spot usually has a Gaussian progression and decreases exponentially toward the spot edges.

Moreover, the laser beams generated by the conventional laser diodes have spatial asymmetries, which is why the spot is substantially elliptical, wherein the length of the major axis of the ellipse may differ significantly from the length of the minor axis of the ellipse. The boundary of the spot is usually assumed to be the location at which the intensity has dropped to $1/e$ or $1/e^2$. The assumed value then defines the boundary with respect to the next row in the luminous image.

This gives rise to the problem that the width of the Gaussian distribution does not allow a sharp differentiation between the rows.

One option to address this problem at least partially is to vary the intensity value assumed for the determination of the row boundary. This, however, gives rise to the additional problem that values that are set too low cause dark stripes between the rows in the luminous image, and consequently also in the light image.

It is an object of the invention to create a laser lighting device in which a light image having improved lighting-related properties can be implemented.

This object is achieved by a laser lighting device of the type mentioned above, in which each primary laser light beam has a first intensity profile, each secondary laser light beam has a second intensity profile different from the first intensity profile, and each secondary laser light beam is directed via a microscanner onto the light conversion means.

In one embodiment that is advantageous with respect to the control engineering complexity, it may be provided that the microscanner can be pivotable about exactly one axis. Such a 1D microscanner may also be used to address EMC problems (EMC denotes electromagnetic compatibility). Compared to the 1D microscanners, the beam deflection means (such as a micromirror), must oscillate significantly faster in the case of microscanners pivotable about two axes so as to allow a uniformly luminous light image to be achieved, since the path used to scan the image is considerably longer. As a result, it must be possible to switch the laser light sources themselves on and off extremely rapidly. In this way, extremely short switching times, and also extremely steep switching edges of the laser light sources, must be implemented so as to efficiently module laser light sources. This is particularly important in the case of suppression scenarios, which is to say when predefined regions of the roadway are to be suppressed, for example due to oncoming traffic or traffic preceding at a close distance or objects on a roadside.

With respect to the reduction of the losses of light during the incoupling of the primary laser beams into the light guide, it is advantageous when a supplementary lens, which couples the primary laser light beam into the first end of the light guide associated with this laser light source, is disposed downstream of each laser light source.

With respect to a compact design and easily controllable heat dissipation, it is advantageous when the secondary laser light beams are divided into two or more laser light beam groups, wherein each laser light beam group is guided by a respective microscanner.

With respect to the divergence of the laser beam, it may be advantageous if the light guides of at least one subset of the light guides are disposed as a cone tapering in the light propagation direction. The light guides (such as glass rods) can be used without being curved. The use of curved light guides (such as fibers) may help increase the divergence of the laser beam in one or in both of the axes thereof (ellipse major axis, ellipse minor axis) and impair the ability to match the laser beam profile size to the size of the microscanner.

With respect to the collimation of the secondary light beams, it may be advantageous if the second ends are disposed and/or designed in such a way that the secondary light beams extend substantially parallel to one another.

So as to generate a luminous image that is divided into rows, it is expedient when the second ends are disposed abutting one another in a row.

With respect to focusing or collimation, it may be advantageous when an optical imaging system is disposed upstream of each microscanner.

It is expedient when the optical imaging system comprises one, two or more lenses and/or one, two or more diaphragms and/or one, two or more reflectors.

With respect to the compact arrangement of the light guides, it may be provided that the primary laser light beams of at least one subset of the primary laser light beams couple into the first ends via at least one beam deflection means, such as a mirror or a prism.

With respect to efficient shaping of the intensity profile of the light beams, it is advantageous when the light guides have a substantially rectangular cross-section.

So as to vary the luminous spot size, it may be advantageous when the light guides have a differently sized cross-section.

With respect to the quality and the resolution of the light image, it is particularly advantageous when the first intensity profile in each spatial direction has a substantially Gaussian shape, and the second intensity profile in each spatial direction has a substantially flat top shape (also known as top hat shape or top hat intensity profile).

Moreover, it may be advantageous when the second intensity profile in each spatial direction has a substantially flat top shape, and the beam cross-section of the secondary light beams is substantially rectangular.

The invention, along with further advantages, will be described in greater detail hereafter based on exemplary embodiments, which are illustrated in the drawings. In the drawings:

FIG. 1 shows a schematic representation of the components of a conventional laser lighting device (AT 514834 A2) which are essential for the invention, and the relationship thereof;

FIG. 1*a* shows two overlapping luminous spots generated by the conventional laser lighting device, and the intensity profiles thereof;

FIG. 2 shows a schematic representation of the essential components of a laser lighting device according to the invention, and the relationship thereof;

FIG. 2*a* shows the laser lighting device according to the invention, comprising conically disposed rigid light guides and a schematically illustrated imaging system;

FIG. 2*b* shows the laser lighting device according to the invention, comprising curved light guides and a schematically illustrated imaging system;

FIG. 2*c* shows two luminous spots generated by the laser lighting device according to the invention, and the intensity profiles thereof;

Figure 2A:
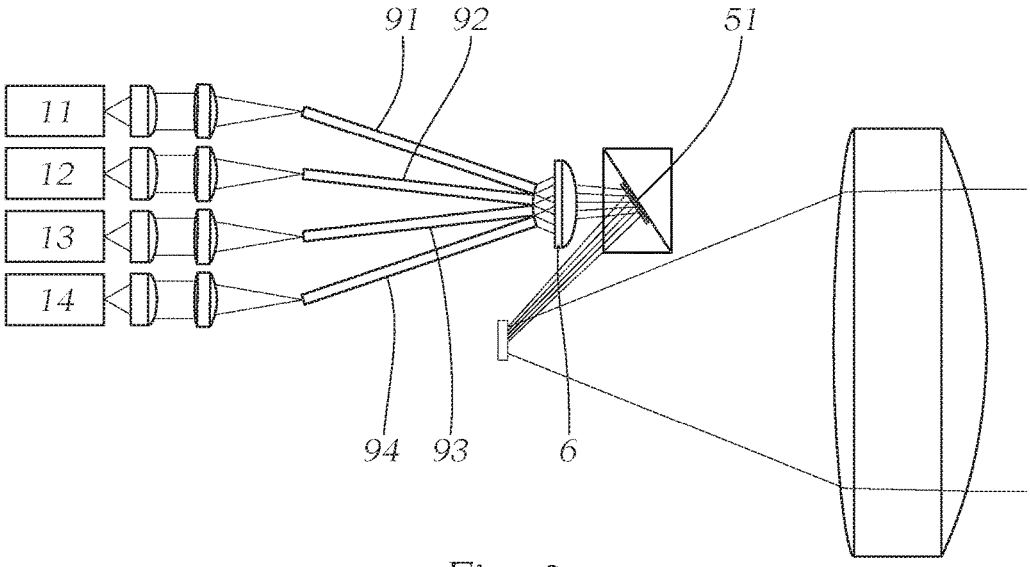

The object to be achieved by the present invention will now be described based on FIG. 1 and FIG. 1*a*. The lighting-related starting point of the laser lighting device shown here is two groups 1 and 2, located on top of one another, of four laser light sources 11, 12, 13, 14 or 21, 22, 23, 24 each, which can each emit a laser beam denoted by 11*p* to 18*p*. The laser light sources 11 to 18 are associated with a laser control unit 3, wherein this control unit 3 is used for power supply purposes and also configured to modulate the beam intensity of the individual lasers. "Modulating" in the context of the present invention is understood to mean that the intensity of a laser light source can be altered, either continuously or in a pulsed manner, within the meaning of switching on and off. What is essential is that the light output can analogously be dynamically altered, depending on the location onto which the beams are directed. Additionally, there is also the option of switching on and off for a certain period of time so as not to illuminate defined areas.

The laser control unit 3, in turn, receives signals from a central headlight control unit 4, which can be supplied sensor signals s1 . . . si . . . sn. These control and sensor signals, on the one hand, may be switching commands, for example, for switching high-beam light to low-beam light or, on the other hand, signals that are picked up by light sensors or cameras intended to detect the lighting conditions on the road and, for example, suppress or weaken certain regions in the luminous image. The laser light sources 11 to 18, which are preferably designed as laser diodes, emit blue or UV light, for example.

A dedicated collimation optical system 21 to 28, which focuses the initially highly divergent laser beam 11*p* to 18*p*, is disposed downstream of each laser light source 11 to 18. Afterwards, the distance of the laser beams of the first group 1 or of the second group 2 is decreased by a shared converging lens 31 or 32, and downstream diverging lenses 41 or 42 keep the exit angle of the laser beams as small as possible.

The four laser beams 11*p*, 12*p*, 13*p* and 14*p* of the first group 1 "focused" in the described manner impinge on a first microscanner 51, and analogously the laser beams 15*p*, 16*p*, 16*p* and 18*p* of the second group 2 impinge on a second microscanner 52, and together are reflected onto a light conversion means 60 designed as a luminous area in the present case. The term "microscanner" here shall be understood to mean a general beam deflection means pivotable about one or two spatial axes, which is usually designed as a micromirror, but does not necessarily have to be designed as such a micromirror, but may also be designed as a prism, for example. The light conversion means 60, in the known manner, comprises a phosphor for light conversion, which converts blue or UV light into "white" light, for example. "Phosphor" in the context of the present invention is generally understood to mean a substance or a substance mixture that converts light having one wavelength into light having a different wavelength or a wavelength mixture, and in particular into "white" light, which can be subsumed under the term "wavelength conversion." "White light" is understood to mean light having a spectral composition that evokes a "white" color impression in humans. Naturally, the term "light" is not limited to radiation visible to the human eye. Optical ceramics may also be used for the light conversion means, which are transparent ceramics such as YAG-Ce (cerium-doped yttrium aluminum garnet).

The microscanner 51 is controlled by a microscanner control unit 5 and caused to oscillate at a constant frequency, wherein these oscillations in particular may correspond to the mechanical natural frequency of the microscanner. The microscanner control unit 5, in turn, is also controlled by the headlight control unit 4 so as to be able to set the oscillation amplitudes of the microscanners 51, 52, wherein asymmetric oscillations about the axis may also be settable. The control of microscanners is known and can take place in a variety of ways, such as electromagnetically, electrostatically, thermoelectrically and piezoelectrically. In tried and tested embodiments of the invention, the microscanners 51, 52 oscillate at a frequency of several hundred Hz, for example, and the maximum amplitude, as a function of the control thereof, is a few degrees to 60°. Advantageously, feedback as to the position of the microscanners 51, 52 is provided to the microscanner control unit 5 and/or to the headlight control unit 4. The two microscanners may oscillate synchronously; however, non-synchronous oscillation may also be used, for example so as to make the thermal load on the luminous area or the light conversion means more uniform.

When the microscanners are held stationary, which is to say not caused to oscillate, the focused laser beams 11*p* to 18*p* generate luminous spots that each have a luminous flux distribution corresponding to the intensity profile of the particular laser light beam on the light conversion means 60, this being the luminous area, which is generally planar, but does not have to be planar. FIG. 1*a* schematically shows two luminous spots 71*p* and 72*p*, which are generated by a laser lighting device of FIG. 1. Each light flux distribution is substantially Gaussian and corresponds to the intensity profile of the two "adjoining" laser beams, such as 11*p* and 12*p*. A sectional view along the line AA shows a light flux curve 73 and is highly relevant for the luminous image to be displayed on the roadway by way of a projection system PS. The light flux curve 73 described here does not allow a sharp differentiation between the luminous spots and results in large light intensity fluctuations in the light image.

The term "roadway" is used for simplified illustration here since, of course, it depends on the local circumstances whether the light image is in fact located on the roadway or also extends beyond it. For example, so as to test the emitted light distributions, a projection of the light image onto a vertical surface area is generated in accordance with the relevant standards that refer to motor vehicle lighting technology.

According to the invention, this object is achieved by shaping the beam profile of the laser light beams. The essential components of a laser lighting device according to the invention comprising technical means by way of which the object is implemented are shown in FIG. 2 based on a non-limiting exemplary embodiment. For the sake of simplicity, only one of the two laser light source groups of FIG. 1 is considered. Disposed downstream of each laser light source 11 to 14 is a dedicated supplementary lens 81 to 84, which concentrates the initially highly divergent primary laser beam 11*p* to 18*p*, and subsequently focuses the first ends 91*e* to 94*e* of the light guides 91 to 94 such that the primary laser light beams are coupled into the light guides substantially without losses. The laser light beams are advantageously coupled into the light guides in such a way that, for example in the case of a rectangular light guide, the longitudinal axis of the laser beam emitted by the laser light source, which typically has an elliptic beam cross-section, runs parallel to the cross-sectional longitudinal axis of the rectangular light guide. In general, the manner of incoupling depends on the axis (ellipse major axis or ellipse minor axis) in which the laser light beams are to have a lower divergence during outcoupling (the second laser light beams).

It shall be noted here that the term "light guides" also subsumes all technical means that are suitable for shaping the beam profile (intensity profile and cross-section of the laser beams). Thus, all "beam profile shaping elements" may be used in a specific technical embodiment of the present invention. For example, it is possible to use multimode fibers or glass rods of various types. The type of a beam profile shaping element refers to the behavior of the refractive index thereof. A distinction is made, for example, between step-index fibers, gradient-index fibers or homogeneous beam profile shaping elements (having a constant refractive index). Moreover, the beam profile shaping elements can have different cross-sectional sizes (from several to hundreds of micrometers, to several millimeters). In this way, the size of the luminous spots on the light conversion means, and consequently the resolution of the light image, may be varied. Furthermore, such a beam profile shaping element may, for example, be implemented as an arrangement of optical systems, such as lenses, mirrors and diaphragms.

The term "supplementary lens" in connection with the present invention shall be understood to mean an optical system that is suitable for focusing the originally diverging primary laser light beams 11*p* to 14*p* onto the associated first ends 91*e* to 94*e*. This supplementary lens can, as in the shown exemplary embodiment, comprise a collimator lens and a converging ens, but alternatively may also comprise other means available to a person skilled in the art which are suitable for focusing the primary laser light beams.

Figure 2C:
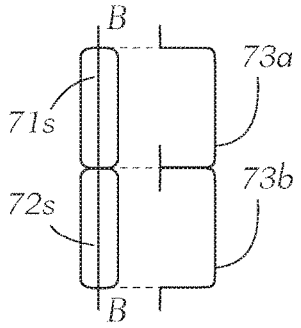
Figure 3:
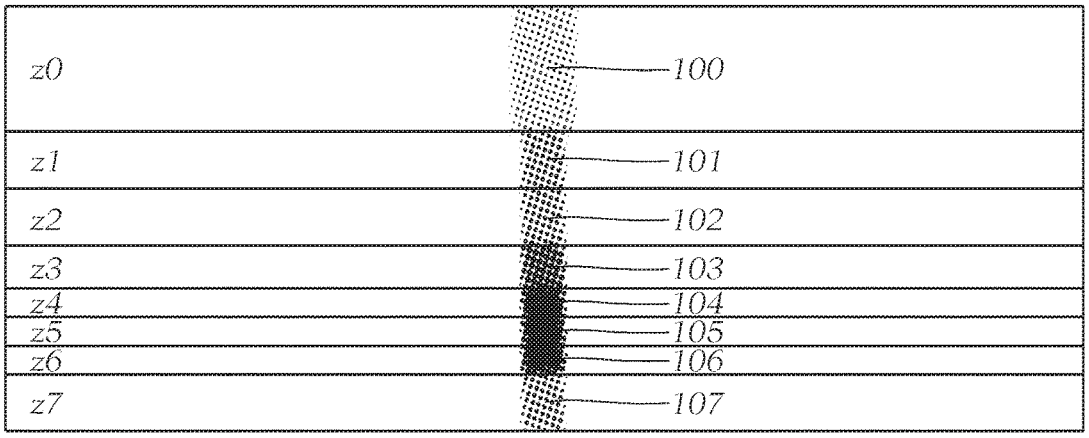
FIG. 3 shows a stationary luminous image generated by the laser lighting device.

During the propagation of the primary laser lights beams 11*p* to 18*p* in the light guides 91 to 94, these are fully reflected multiple times. This causes the light to "fill" the entire cross-section of the light guide. The beam profile of the light beams exiting the light guides as secondary light beams 11*s* to 14*s* substantially takes on the shape of the cross-section of the light guides. The light guides used in connection with the present invention have a substantially rectangular cross-sectional shape. Accordingly, the secondary light beams 11*s* to 14*a* have a substantially rectangular intensity profile. FIG. 2*c* shows two rectangular luminous spots 71*s* and 72*s* generated on the light conversion means 60 by two of the secondary light beams, such as by 11*s* and 12*s*, the luminous spots corresponding to a substantially rectangular beam cross-section and a substantially rectangular intensity profile, in technical literature also referred to as flat top or top hat shape, or simply top hat, of the secondary light beams and having a substantially rectangular luminous flux curve 73*a* and 73*b* along the section BB. The size of the cross-section may vary from light guide to light guide and consequently result in differently sized luminous spots on the light conversion means 60. In this way, it is also possible to adapt the luminous flux density (illumination intensity) in a luminous spot, and consequently the luminous intensity of this luminous spot. This is addressed in FIG. 3, which shows eight luminous spots 100 to 107 having varying sizes and varying luminosities. Such luminous spots are created when the microscanners 51, 52 do not oscillate. When these are caused to oscillate by the microscanner control unit 5, whereby the microscanners 51, 52 are pivoted about an axis, luminous bands z0 to z8 are created on the light conversion means.

Even though the preferred exemplary embodiment shows microscanners that pivot only about one axis, it is also possible to use microscanners that pivot about two axes. In this case, multiple laser beams may be directed at such a microscanner, generating light bands directly bearing on one another. Embodiments comprising only a single microscanner are also conceivable, in which, for example, the secondary laser beams impinge directly on the microscanner counter to the main radiation direction of the headlight, the microscanner then directing the laser beams onto a transilluminated phosphor.

Figure 2B:
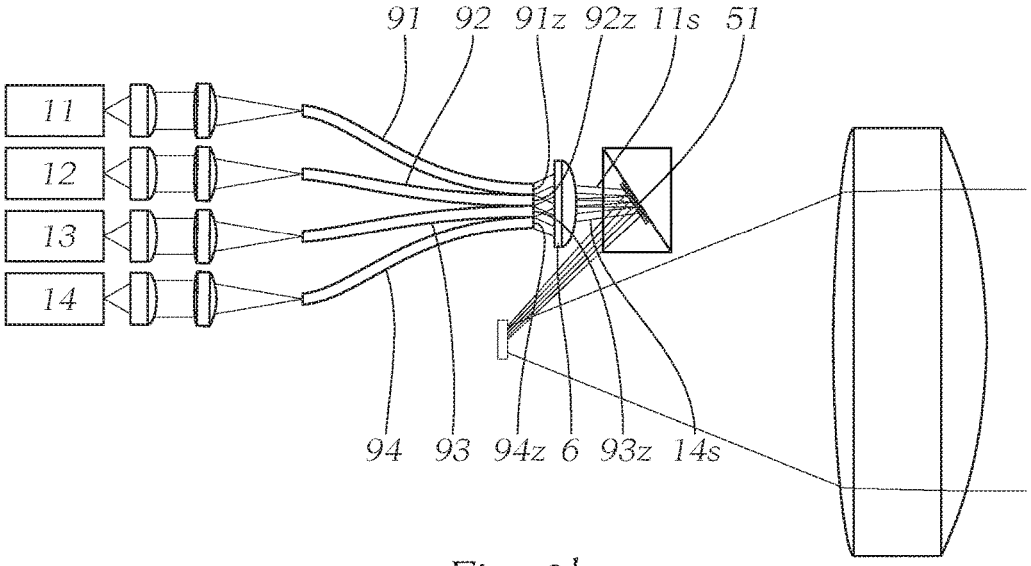

FIG. 2*a* and FIG. 2*b* show two embodiments of the present invention in which the secondary laser light beams 11*s* to 14*s* reach the microscanner 51 via an optical imaging system 6. The imaging system 6 is schematically shown as a converging lens here. In general, this is an optical system that comprises one, two or more lenses, which are disposed behind one another and/or are associated with a respective light guide, and/or reflectors, and that collimates/focuses the secondary light beams 11*s* to 14*s* onto the light conversion means 60 via the microscanner 51.

FIG. 2*a* shows light guides 91 to 94, which are disposed as a cone tapering in the light propagation direction. In this arrangement, the light guides 91 to 94 may run "rigidly."

FIG. 2*b* shows a light guide arrangement that is particularly suitable for light guides 91 to 94 designed as multimode fibers. The light guides may be curved and disposed in such a way that the second ends 91*z* to 94*z* are disposed abutting one another in a row. As a result, the secondary laser light beams 11*s* to 14*s* run substantially parallel, wherein the distance between the luminous spots on the light conversion means 60 can be minimized by the optical imaging system 6.

Figure 4:
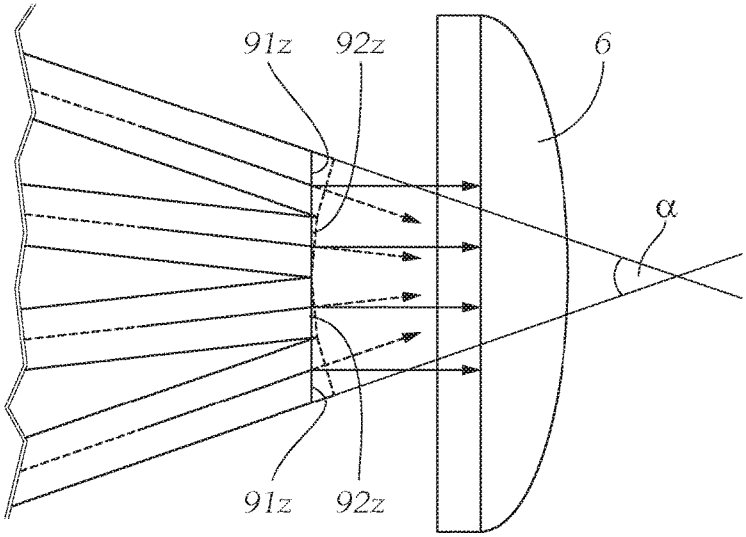
FIG. 4 shows an exemplary arrangement of the light guide ends from FIG. 2*a*.

FIG. 4 shows an arrangement of the light guide ends from FIG. 2*a*. Even though the light guides 91 to 94 converge toward one another conically at an opening angle $\alpha$, the second ends 91*z* to 94*z* are designed such, for example by grinding, that the secondary light beams 11*s* to 14*s* run substantially parallel to one another. The opening angle $\alpha$ cannot become arbitrarily large since this would necessitate appropriate grinding of the second ends 91*z* to 94*z* and would cause undesirable distortions in the luminous image, and consequently in the light image.

It shall be noted here that the arrangement shown in FIG. 4 involves a special case. In practice, it is certainly possible for the second ends 91*z* to 94*z* not to be situated in one plane. The grinding angle is predefined by the law of refraction and by the opening angle $\alpha$. The configuration of the second ends 91*z* to 94*z* (due to grinding) serves as a technical means to ensure that the secondary laser light beams, which generate the luminous spots on the light conversion means, impinge on the light conversion means at a predefined angle, and preferably parallel to one another.

Figure 5:
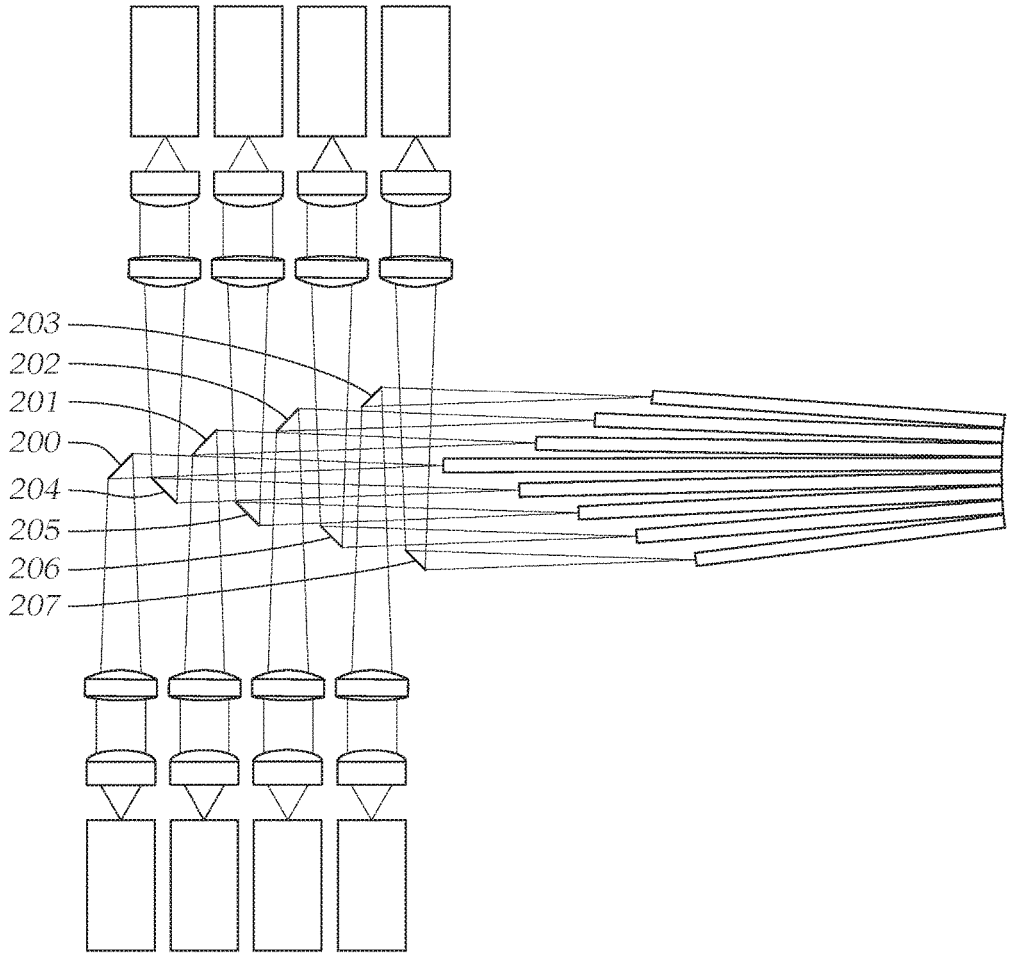
FIG. 5 shows a schematic representation of an incoupling of the primary beams into the light guides by way of deflection mirrors.

In an embodiment shown schematically in FIG. 5, the primary laser light beams are coupled into the first ends by way of mirrors 200 to 207 (by way of a so-called "mirror cascade"). In this way, it is possible to decrease the opening angle $\alpha$ and implement optimized cooling of the laser diodes since these can be disposed in one plane, whereby an easier connection to a shared heat sink can be achieved. Even though a mirror cascade was used in this exemplary embodiment, this may be replaced by other technical means, referred to generally as beam deflection means, suitable for deflecting light. For example, some or all of the mirrors 200 to 207 may be replaced with prisms. Likewise, arrangements in which two or more primary laser beams are deflected by one and the same beam deflection means are conceivable as well.

In the shown exemplary embodiments of the present invention, there is no overlapping of the luminous bands on a luminous area or a light conversion means, and the luminous image thus generated is projected onto the roadway. However, it is also possible for two or more separate laser lighting device according to the invention to be provided in a headlight, wherein these are oriented with respect to one another in such a way that the overlapping of the light images takes place. Even though one group or two groups, each comprising four laser light sources, are described in the shown exemplary embodiments, it should be obvious to a person skilled in the art that multiple groups, comprising a different and varying number of laser light sources, in keeping with the particular purposes, are also conceivable.

The invention claimed is:

1. A laser lighting device for vehicles comprising:

two or more laser light sources (11 to 18), wherein each laser light source is configured to generate a primary laser light beam (11*p* to 18*p*); and a light guide (91 to 94) associated with each laser light source, wherein each primary laser light beam is coupled into a first end (91*e* to 94*e*) of the light guide and decoupled from a second end (91*z* to 94*z*) of the light guide as a secondary laser light beam (11*s* to 14*s*), and each secondary laser light beam is directed onto a light conversion means (60) so as to generate a predefined luminous image thereon, which via a projection system (PS) associated with the light conversion means is projected as a light image onto the roadway, wherein:

each primary laser light beam has a first intensity profile (71*p*, 72*p*);

each secondary laser light beam has a second intensity profile (73*a*, 73*b*) different from the first intensity profile; and each secondary laser light beam is directed via a microscanner (51, 52) onto the light conversion means;

the second ends (91*z* to 94*z*) are disposed abutting one another in a row; and the light guides have a differently sized cross-section.

2. The laser lighting device according to claim 1, wherein the microscanner (51, 52) is pivotable about exactly one axis.

3. The laser lighting device according to claim 1, wherein a supplementary lens (81 to 84), which couples the primary laser light beam into the first end (91*e* to 94*e*) of the light guide (91 to 94) associated with this laser light source, is disposed downstream of each of the two or more laser light sources.

4. The laser lighting device according to claim 1, wherein the secondary laser light beams are divided into two or more laser light beam groups, wherein each laser light beam group is guided by a respective microscanner (51, 52).

5. The laser lighting device according to claim 1, wherein the light guides (91 to 94) of at least one subset of the light guides are disposed as a cone tapering in the light propagation direction.

6. The laser lighting device according to claim 1, wherein the second ends are disposed and/or designed in such a way that the secondary light beams extend substantially parallel to one another.

7. The laser lighting device according to claim 1, wherein an optical imaging system (6) is disposed upstream of each microscanner.

8. The laser lighting device according to claim 7, wherein the optical imaging system (6) comprises one, two or more lenses and/or one, two or more diaphragms and/or one, two or more reflectors.

9. The laser lighting device according to claim 1, wherein the primary laser light beams of at least one subset of the primary laser light beams are coupled into the first ends via at least one beam deflection means (200 to 207) comprising a mirror or a prism.

10. The laser lighting device according to claim 1, wherein the light guides have a substantially rectangular cross-section.

11. The laser lighting device according to claim 1, wherein the first intensity profile in each spatial direction has a substantially Gaussian shape, and the second intensity profile in each spatial direction has a substantially flat top shape (73*a*, 73*b*).

12. The laser lighting device according to claim 1, wherein the second intensity profile in each spatial direction has a substantially flat top shape (73*a*, 73*b*), and the beam cross-section of the secondary light beams is substantially rectangular (71*s*, 72*s*).

13. A headlight comprising at least one laser lighting device according to claim 1.

14. A vehicle comprising at least one headlight according to claim 13.

* * * * *